US006692171B2

(12) United States Patent
Vito

(10) Patent No.: US 6,692,171 B2
(45) **Date of Patent: *Feb. 17, 2004**

(54) SQUEEGEE WITH HANDLE AND REMOTE SPRAYER

(76) Inventor: John Vito, 519 School St., Clarks Summit, PA (US) 18411

( * ) Notice: Subject to any disclaimer, the term of this patent is extended or adjusted under 35 U.S.C. 154(b) by 0 days.

This patent is subject to a terminal disclaimer.

(21) Appl. No.: 10/273,065

(22) Filed: Oct. 17, 2002

(65) Prior Publication Data

US 2003/0044220 A1 Mar. 6, 2003

Related U.S. Application Data

(63) Continuation-in-part of application No. 09/886,713, filed on Jun. 21, 2001, which is a continuation-in-part of application No. 09/737,023, filed on Dec. 11, 2000.

(51) Int. Cl.[7] ..... A47L 1/05; A47L 1/08

(52) U.S. Cl. ..... 401/138; 401/139; 401/140; 401/146

(58) Field of Search ..... 401/138, 139, 401/140, 146, 263, 266, 267; 239/532; 222/174

(56) References Cited

U.S. PATENT DOCUMENTS

| | | | | |
|---|---|---|---|---|
| 622,809 | A | 4/1899 | Keyser | |
| 1,783,506 | A | 12/1930 | Homiller | |
| 3,377,123 | A | 4/1968 | Leeson | |
| 3,658,432 | A | 4/1972 | Lanusse | |
| 4,023,711 | A | 5/1977 | Sena | |
| 4,089,440 | A | 5/1978 | Lee | |
| 4,457,472 | A | 7/1984 | Gerberth, Jr. | |
| 4,776,716 | A | 10/1988 | Huang | |
| 5,165,811 | A | 11/1992 | MacLeod | |
| 5,186,392 | A | 2/1993 | Pleshek | |
| 5,364,198 | A | 11/1994 | Skenderi | |
| 6,010,267 | A | 1/2000 | Vito | |
| 2002/0071710 | A1 * | 6/2002 | Vito | 401/266 |

* cited by examiner

*Primary Examiner*—Gene Mancene
*Assistant Examiner*—Kathleen J. Prunner
(74) *Attorney, Agent, or Firm*—Kenneth P. Glynn, Esq.

(57) ABSTRACT

A squeegee with squeegee handle and remote spraying device, includes a squeegee section having an enclosed container for holding liquid, a sprayer head, which is in connection with the squeegee section, and a surface extending in a lengthwise direction. The enclosed container has a threaded neck. The sprayer head has a threaded cap adapted for engaging the threaded neck, as well as a dispensing means for dispensing the liquid. The dispensing means includes a trigger being in connection with a conduit, a nozzle at an end of the sprayer head, and pressure inducing means for inducing a pressure change in the conduit so as to draw spraying agent into the conduit and out of the nozzle. The conduit extends through the threaded cap and into the enclosed container. There is also a squeegee blade attached to the sprayer head and being nearly perpendicular to the surface of said enclosed container. In preferred embodiments, an extended handle further includes a plurality of sections in which each section extends to allow for longer reaching range.

20 Claims, 2 Drawing Sheets

SQUEEGEE WITH HANDLE AND REMOTE SPRAYER

REFERENCES TO RELATED APPLICATION

This application is a continuation-in-part of co-pending application Ser. No. 09/886,713, filed on Jun. 21, 2001 and entitled "Spray Squeegee Having Automatic Recipient Surface Wetting Mechanism With Extension and Remote Triggering System", by the same inventor herein. This application is also a continuation-in-part to co-pending application Ser. No. 09/737,023, filed on Dec. 11, 2000, entitled "Squeegee with Squeegee Handle and Remote Spraying Device", by the same inventor herein.

BACKGROUND OF THE INVENTION

1. Field of the Invention

The present invention relates to the field of wiping devices and, in particular, to a novel squeegee with a handle. More particularly, it relates to those wiping devices having various sized, shaped, and operational pole extended handles.

2. Information Disclosure Statement

There are many utility patents and design patents relating to wiping devices. The following is representative of the art:

U.S. Pat. No. 6,010,267 to John Vito, the same inventor herein, which issued on Jan. 4, 2000, discloses an extended squeegee and fluid delivery system for cleaning in places that are of high elevation. A squeegee is used in connection with an extended handle. The spray system has a pump that delivers a cleaning agent through a conduit in connection with the squeegee. There is a trigger in connection with the spray bottle and near the end of the handle where the user is holding the handle. The user may then deliver cleaning agent out the nozzle by squeezing on a trigger or pull cord in connection with the handle. The handle of the squeegee may be made hollow in order to deliver the cleaning agent from the source of the agent to the nozzle in connection with the squeegee.

The device is directed to telescoping poles and having a pressure inducing means, which causes a drop in pneumatic pressure.

U.S. Pat. No. 5,364,198 to Skenderi describes and illustrates a self contained window cleaning implement, which has and elongated handle member, a squeegee member located on one end of the elongated handle member, a spray nozzle for dispensing a spray, a reservoir for holding a supply of cleaning fluid, a tube extending from the reservoir to the spray nozzle for transferring the cleaning fluid from the reservoir to the spray nozzle, and a manually actuable pump apparatus for forcing the cleaning fluid from the reservoir, through the tube, and to the spray nozzle. The spray nozzle is located on the one end of the elongated handle member adjacent to the squeegee member. The squeegee member extends at an oblique angle upward and downward from the elongated handle member. The spray apparatus is located above the squeegee member. The reservoir is attached to the other end of the elongated handle member opposite the one end of the handle member. The manually actuate pump apparatus is located on the other end of the elongated handle member and including a digitally depressible trigger member.

U.S. Pat. No. 5,186,392 to Pieshek discloses an extendable liquid-applying device of the type used for cleaning interior walls and ceilings. The device includes first and second tubular members telescoped together and slidable relative to one another to extend and retract the device. One of the members has a proximal end. The other has a distal end and an attached angularly-oriented nozzle. A continuous length of coiled flexible hose extends within the members and connects to the nozzle member. That is, the hose extends unbroken along the lengths of the members, from the proximal end to the distal end, to provide discharge from the nozzle member regardless of the relative positions of the members. A separate base member plugs into the proximal end and has a valve for controlling liquid flow. With a nozzle attached thereto, the base member can be used alone for "close-in" cleaning.

U.S. Pat. No. 5,165,811 to MacLeod relates to a cleaning apparatus having an elongate handle, which mounts a support plate having a head member thereon. The head member includes a removably mounted sponge head securable to a forward face of the head member. A flexible polymeric arcuate plate is removable mounted to a rear face of the head member. The invention includes the handle formed with a refillable reservoir, wherein the handle is deformable to effect pressurizing of the reservoir and to effect directing of fluid through a supply conduit to a further supply conduit, Thereafter, it directs cleaning fluid to the sponge through a series of valve plugs directed through the further supply conduit.

U.S. Pat. No. 4,776,716 to Huang relates to a foldable multipurpose cleaning device which includes a fluid-receiving receptacle member detachably connected to a cleaning head assembly. The receptacle member includes a plunger and dispensing means for the fluid. The cleaning head assembly includes and elongated scraper of squeegee and an brush or sponge borne on a carriage member. There is also an intermediate coupling member projecting from the carriage member and comprising a female housing member with a locking notch in its base, a slotted body member topped with a male head portion that has near its base a lug that is engageable with the notch on the female engaging member in a releasable gripping relationship when the carriage member is in a generally horizontal position for operation. The female housing member is pivotally attached to the male head portion by means of oppositely disposed pivot pin elements projecting from the male head portion into corresponding pivot slots in the female housing member for slip joint action therebetween.

U.S. Pat. No. 4,457,472 to Gerberth, Jr. describes and illustrates an extendable spray gun for hydraulically atomizing and spraying liquids such as paint. A paint spray device is detachable mounted to one end of a telescopically extendable pole while the operation thereof is remotely controlled or actuated by a triggering mechanism. The triggering mechanism is located at the other end of the pole where a handle is provided. The triggering mechanism includes means which automatically compensates for changes in pole length so that positive and direct actuation of the spray device by the triggering mechanism is unaffected.

U.S. Pat. No. 4,089,440 to Lee discloses a handle attachment snap, which engages over the top of an aerosol can. It includes a trigger adapted to depress a spray button. The device fits most sizes of cans and adapter rings may be provided t ensure a firmer support for smaller cans. The handle attachment and associated aerosol can may be secured to and elevated on a pole or other elongated support. The handle attachment is capable for remote operation for spraying of trees, buildings, and the like. A partially rotatable shroud is provided which when in one position, enables the trigger to be operated in order to dispense the contents of the can through the spray nozzle and when in the other position, prevents the trigger from being depressed and also shrouds the nozzle if the can is improperly placed within the assembly.

U.S. Pat. No. 4,023,711 to Sena relates to a paint spray gun which is locked into a receptacle at the free end of a tubular arm pivoted a t one end of an elongated tubular stock. The spray gun trigger is engaged by an operating finger, spring-biased toward the "off" position. The finger is operated by means of a sheathed, flexible cable through and operating lever mounted a the end of the stock farthest from spray gun receptacle. The relative angular position of the receptacle-bearing arm and the stock are adjustable. A quick-release receptacle is provided to permit the removal and reassembly of the spray gun to the extension arm with facility.

U.S. Pat. No. 3,658,432 to Lanusse describes and illustrates a spreader for applying make-up, paint, or like fluid product. It includes a detachable container for the product, which is secured to a body. The body includes a source of electrical energy for feeding an electrical motor driving a pump, a handle carrying a control means for the motor, and a working head enclosing partially a freely rotatable roller provided with an absorbent lining which receives the product from an internally disposed sprinkling ramp fed by the pump.

U.S. Pat. No. 3,377,123 to Leeson relates to a cleaning device, which includes a telescoping hollow handle through which water is fed from a valve controlled hose connection at one end of the handle to a discharge nozzle located at the other end. The nozzle is mounted on a retaining plate for a cleaning pad and water is discharged from the nozzle generally parallel with the cleaning pad and laterally thereof so that a detergent may be applied to the pad without being rinsed off by the water discharged from the nozzle. The retaining plate is pivotally mounted so that the pad and nozzle and be adjusted to lie generally parallel with the axis of the handle or ant an angle thereto. A squeegee blade is also pivotally mounted on the retaining plate.

U.S. Pat. No. 1,783,506 discloses a glass cleaning device, which includes a hollow handle functioning as a container for a limited supply of water, and a force-feed hand manipulated pump carried thereby for forcing the water into a distributing and spraying head. The distributing and spraying head is carried by the upper end of the handle, whereby allowing for water to be sprayed against a window at the users discretion, and to be subsequently scrubbed or wiped therefrom by a rubber squeegee strip mounted on the head.

U.S. Pat. No. 622,809 to Keyser relates to a window cleaner. It includes a handle upon which is surmounted a metallic sphere or hollow ball, above which is secured a horizontally disposed cylindrical water-tank, The water tank communicates with a hollow sphere by means of a spout projecting from an underside of the tank into the ball. The device further includes a hollow rubber ball mounted upon the spout of the tank within the metallic ball, a hollow rubber ball mounted upon the spout of the tank within the metallic ball, a rubber tube leading from the interior of the metallic ball through the spout and tank and ending in a nozzle at the upper end, means for compressing the rubber ball to discharge water from the nozzle, means for filling the tank, a holder for a rubber drier, and a holder for a drying cloth or chamois skin also attached to the tank.

Notwithstanding the aforesaid prior art, the present invention system is neither taught nor rendered obvious thereby.

SUMMARY OF THE INVENTION

The present invention is a squeegee with a squeegee handle and remote spraying device, which includes a squeegee handle having an enclosed container, also referred to as an enclosed reservoir, for holding liquid, a spray head which is in connection with a squeegee section, and a surface extending in a lengthwise direction. The enclosed container has a threaded neck.

The sprayer head has a threaded cap adapted for engaging the threaded neck, as well as a dispensing means for dispensing the liquid. The dispensing means includes a trigger being in connection with a conduit, a nozzle at an end of the sprayer head, and pressure inducing means for inducing a pressure change in the conduit so as to draw spraying agent into the conduit and out of the nozzle. The pressure inducing means may cause either an increase or a decrease in pneumatic pressure. The conduit extends through the threaded cap and into the enclosed container.

There is also a squeegee section having a squeegee blade attached to the sprayer head and being nearly perpendicular to the surface of the enclosed container. In the embodiments, the squeegee blade may be aligned anywhere in relationship to the nozzle; i.e., above, at, or below.

In some embodiments, the device further includes an extended handle being connected to the squeegee handle and extending downwardly therefrom. In some embodiments, the extended handle is integrally formed as one surface. In other embodiments, there are extending sections which allow for an infinite extension in length of the extended handle. The size and shape of the extended handle may include, but is not limited to, elongated circular, stocky circular, elongated polygonal, stocky polygonal, and the like.

In preferred embodiments, the extended handle further includes a plurality of sections in which each section includes extending means for extending each of the sections so that the extended handle is extended in length. The extending means may include, but are not limited to, telescoping attached sections, screw-in sections, clamped sections, hook and aperture sections, and the like.

BRIEF DESCRIPTION OF THE DRAWINGS

The present invention should be more fully understood when the specification herein is taken in conjunction with the drawings appended hereto wherein:

FIG. 7 shows a triggering system for an electric motor operated pump which may be used in conjunction with the present invention squeegee with squeegee handle and remote spraying device shown in FIG. 1; while

DETAILED DESCRIPTION OF THE PRESENT INVENTION

The present invention is a squeegee with squeegee handle and remote spraying device, which includes a squeegee handle having an enclosed container for holding liquid, a sprayer head, which is in connection with a squeegee section, and a surface extending in a lengthwise direction. The enclosed container has a threaded neck.

The sprayer head has a threaded cap adapted for engaging the threaded neck, as well as a dispensing means for dispensing the liquid. The dispensing means includes a trigger being in connection with a conduit, a nozzle at an end of the sprayer head, and pressure inducing means for inducing a pressure change in the conduit so as to draw spraying agent into the conduit and out of the nozzle. The conduit extends through the threaded cap and into the enclosed container.

There is also a squeegee section having a squeegee blade attached to the sprayer head and being nearly perpendicular to the surface of the enclosed container. In the embodiments, the squeegee blade may be aligned any where in relationship to the nozzle; i.e., above, at, or below.

In some embodiments, the device further includes an extended handle having a threaded section at one end. The extended handle is removably attached to the squeegee section through the threaded sections of the squeegee section and the extended handle. In some embodiments, the extended handle is integrally formed as one surface. In other embodiments, there are extending sections which allow for an infinite extension in length of the extended handle. The size and shape of the extended handle may include, but is not limited to, elongated circular, stocky circular, elongated polygonal, stocky polygonal, and the like.

In preferred embodiments, the extended handle further includes a plurality of sections in which each section includes extending means for extending each of the sections so that the extended handle is extended in length. The extending means may include, but are not limited to, telescoping attached sections, screw-in sections, clamped sections, hook and aperture sections, and the like.

As used hereinafter below, a user's reaching distance is defined to be the distance achieved by an extension of one's arm with the length of the squeegee handle added to it. An extended reaching distance is defined to be a user's reaching distance plus the sum of the length of each extended handle section.

Figure 1:
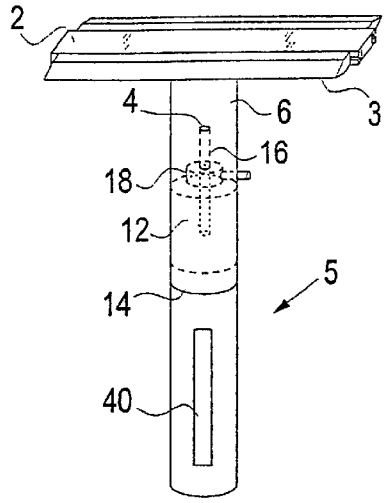
FIG. 1 shows a side partially transparent view of a present invention squeegee with squeegee handle and remote spraying device having an integrally formed elongated handle.
Figure 2:
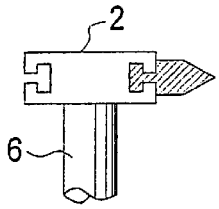
FIG. 2 shows detail of "T"-shaped squeegee section of the present invention device shown in FIG. 1.

Referring now to FIG. 1 and FIG. 2, there is shown a side partially transparent view, and a "T"-shaped squeegee section view, of the present invention squeegee with squeegee handle and remote spraying device, respectively. As shown in FIG. 1, the device includes an extended handle 5 on a lower section and a squeegee handle 6 on an upper section. As shown, the extended handle 5 is integrally formed, elongated and circular in outer measurement. In other embodiments described hereinafter below, an extended handle may include a plurality of extendable sections and may have various other sizes and shapes.

A squeegee section 2 is in connection with a top of the squeegee handle 6 and forms a "T" with that section. The squeegee handle 6 has a nozzle 4 located beneath the squeegee section 2 and a surface, as shown, extending in a lengthwise direction. Together, the squeegee handle 6 and the extended handle 5 or pole make up the majority of the vertical length in the apparatus. The squeegee handle 6 includes a reservoir 12 that contains a spraying agent, i.e., water, alcohol, glycol, and the like. The squeegee handle 6 and the extended handle 5 are joined together by threads 14, in this embodiment, but may be any similar connecting means known in the art. The extended handle 5 includes attaching means 40, which stores various attachments when they are not in use on the squeegee section 2. Such attachments include, but are not limited to, a blade, a clamp, a sponge, wiping means, an electrostatic dust remover such as SWIFTER®, and the like.

Figure 3:
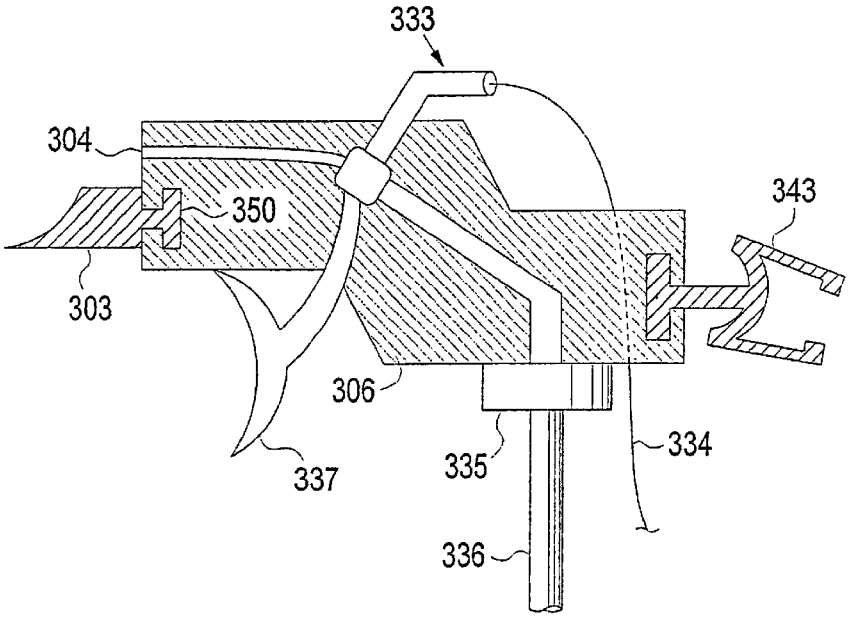
FIG. 3 shows a sprayer head which may be used in conjunction with the present invention device shown in FIG. 1.

The nozzle 4 of a pump 18 is in connection with the squeegee section 2. It is preferred that a squeegee blade 3 be at or above the level of the nozzle 4, as shown in FIG. 1. Alternatively, however, the blade 3 may be constructed at or below a top of the squeegee handle 6 so that the nozzle may be above the blade 3, thereby allowing the spray to be delivered to the desired surface for wiping, cleaning and the like, without hitting the blade. FIG. 3, described hereinafter below, shows in operation alignment of at or below relative placement of a blade to a nozzle.

The squeegee handle 6 further includes a source of spraying agent, e.g., a reservoir 12 or some other container, a pump means for moving the spraying agent by a pressure inducing means, and preferably a conduit 16, which provides a path for the spraying agent from a source to the nozzle 4, which is in close connection with the squeegee section 2. The pressure inducing means may induce either an increase in pneumatic pressure or a decrease in pneumatic pressure to draw spraying agent into the conduit 16 and out of the nozzle 4.

An end of the squeegee handle 6 contains a portion of the squeegee section 2 that is "T"-shaped. It includes at least one attaching means for attaching various cleaning-related items, such as blade 3, or a rubber blade, a rigid blade, a clamp, a sponge, a wiper, an electrostatic dust remover such as SWIFTER®, and the like. In this case, the attaching means is the "T"-shaped portion, but it could also be a channel, a clamp, cut-out portions for inserting a cleaning-related item, and the like.

A spraying system, which includes the reservoir 12, the conduit 16 and the nozzle 4, may be any state of the art means. Typical systems found in connection with aerosol sprays, squirt guns or bicycle pumps are suitable systems whose basic construction may be adapted in order to fit into the system described herein. Typically, such systems rely on an enclosed reservoir 12 or reservoir that is in connection with a pump 18. The pump 18 is activated by a trigger 10 that then delivers air to the spraying agent in the reservoir 12, so that the spraying agent is forced through the conduit 16 and out the nozzle 4 of the reservoir 12.

Referring now to FIG. 2, there is shown details of the squeegee section 2 shown in FIG. 1. The squeegee section 2 may include a standard type sponge scrubber held by a clamp, or, in the alternative the scrubber may me made integral with the spraying section without the need for a clamp. It is preferred that each side of the squeegee have a "T"-shaped channel in order that various types of wiping means 3 for wiping a recipient surface may be attached to a head of the squeegee section 2. Such wiping means include, but are not limited to, rubber blades, plastic blades, sponges, electrostatic dust removers such as SWIFTER®, and the like. In addition, clamps may be attached to a channel to hold a fabric, paper, or sponge, and the like.

The use of a second channel on another side of the squeegee section 2 will allow for two type of wipers, e.g., a sponge and a blade, which may be mounted on a top of the squeegee section 2 to allow for dual usage. A user may rotate the extended handle 180 degrees to expose the wiping means to a remote object and thus wipe a surface from the remote object.

Referring now to FIG. 3, there is shown details of a sprayer head 306. A blade 303 is in connection with the nozzle 304. The blade 303 may be above, at or below the nozzle 304. However, in this embodiment, the blade 303 is below the nozzle 304. A conduit 336 is in connection with a trigger 337 that acts as a pump when the trigger 337 is pulled. A threaded portion 335 may be attached to a conventional spray bottle sold commercially, in order to provide users with different reservoirs. Alternatively, the threader portion may be attached to a threaded pole section, e.g., squeegee handle 6 shown in FIG. 1.

Still yet referring to FIG. 3, attaching means, is this case a "T"-shaped channel 350, is used in connection with the nozzle 304. The channel 350 may be located either on a top or a bottom surface of the nozzle 304 and it is used for attachment of various cleaning-related means, such as a rubber blade 303, a rigid blade, a clamp, a sponge wiper, an electrostatic dust remover such as SWIFTER®, and the like. The channel 350 is similar to that channel shown in cross section in FIG. 2.

Blade 303 is attached to the "T"-shaped channel 350 end of the sprayer head 306. The clamp holds paper towels, sponges, electrostatic dust removers, and other similar wiping means. The clamp 343 may be a releasable type, e.g., and alligator clip in order to change the wiping means. A pivoting section 333 in connection with a pull line 334, which may be used to activate the sprayer when a relatively longer pole section is used. The pull line 334 may be attached to a retractable spool at an end of the extended handle or pole, or hang free.

Figure 4:
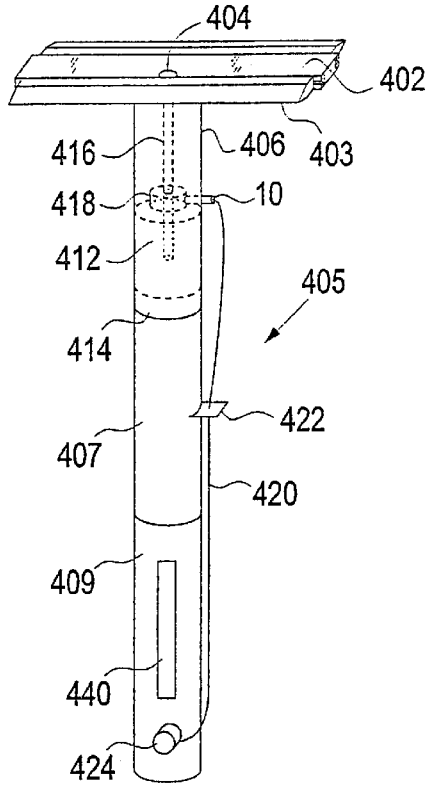
FIG. 4 shows a side partially transparent view of a present invention squeegee with squeegee handle and remote spraying device having an extended handle formed from a plurality of telescoping sections, with at least one telescoping sections being extended.

Referring now to FIG. 4, there is shown a present invention squeegee with squeegee handle and remote spraying device having an extended handle 405 formed from a plurality of telescoping sections 407, 409, with at least one telescoping section being extended. In this drawing, similar parts are identically numbered to those in FIG. 1, but beginning with "400".

The plurality of telescoping sections 407, 409 are located within each other when the extended handle 405 is unextended. When the extended handle 405 is extended, a user slides a portion nearest the squeegee handle 6 downwardly along a telescoping means and extends the extended handle 405 to a maximum length of a telescoping section 407. Although this embodiment shows telescoping attached sections, other conventional means known in the art for attaching and extending sections are within the scope of this invention. Such means include, but are not limited to, screw-in sections, clamped sections, hook and corresponding aperture sections, and the like. As shown, a nozzle 404 is at or near a blade 403.

In this embodiment, the pumping system and a container 412 may be mounted in the extended handle 405 and is in close connection to a squeegee section 402 near an end of the extended handle 405. A trigger is close to a pump 418 itself and thus the trigger would be some distance above a user who may be several feet below the recipient surface, when the extended handle 405 is extended. The trigger is in connection with a line 420 or some similar extending member that extends downward from the squeegee section 402 at opening 10 and toward the ground or other surface. Eyelets 422 may be used on the extended handle so that the line 420 may be threaded through them and extended to the ground or other surface. Thus, the user can activate the trigger from a distance below the trigger by manipulating the line through pulling, moving, rotating, and the like.

The line 420 may be wound at the bottom of the telescope extended handle 405 in a retractable spool 424 that takes up slack in the line 420. The spool 424 would be constructed on a an outermost telescoping section 409 of the extended handle 405. Thus, the line 420 will be let out as the extended handle 405 is extended and taken up when the extended handle 405 is retracted or shortened, by moving an appropriate telescoping sections upwardly. Moreover, by remotely activating the trigger, an extended reaching distance is attained, which is at least as great as an expanse of a user's reaching distance by using limbs and the like.

The line 420 may also be attached to the trigger without the use of the spool 424. Eyelets 422 may optionally be used for controlling the movements of the line 420, but are not necessary for the scope of the present invention. Alternatively, the line could be attached to the trigger and would then dangle freely. Moreover, the trigger may have an eyelet to attach the pull line wherein the pull line has a metal clip on an end that will clip into the eyelet on the trigger. Of course, the clip at the end of the pull line will need to be smaller that the eyelets on the side of the spray squeegee and extended handle sections, so that the clip will pass through the eyelets to reach and clip onto the trigger eyelet.

Figure 5:
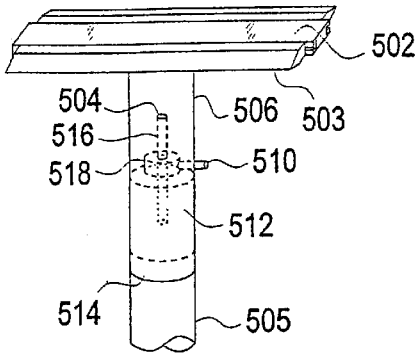
FIG. 5 shows a side partially transparent view of a present invention squeegee with squeegee handle and remote spraying device having an extended handle which is stocky in shape.

Referring now to FIG. 5, there is shown a present invention squeegee with squeegee handle and remote spraying device having an extended handle 505 that is stocky in shape. In this drawing, similar parts are identically numbered to those in FIG. 1, but beginning with "500" for example, nozzle 510.

The extended handle 5 is connected to a squeegee handle 506 at connection means 514. In this embodiment, both the extended handle 505 and the squeegee handle 506 are polygonal-shaped, having four sides. It is within the scope of this invention that any polygonal-shaped extended handle and mating squeegee handle may be used for connection to a squeegee section 502.

Figure 6:
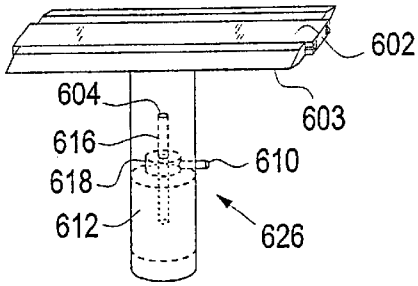
FIG. 6 shows a side partially transparent view of a present invention squeegee with squeegee handle and remote spraying device having only an enclosed container.

Referring to FIG. 6, there is a present invention squeegee with squeegee handle and remote spraying device having an enclosed container 626 for a squeegee handle. Similar parts are identically numbered to those in FIG. 1, but beginning with "600" for example, nozzle 610. The operation is similar to the operation described by FIG. 1.

Figure 7:
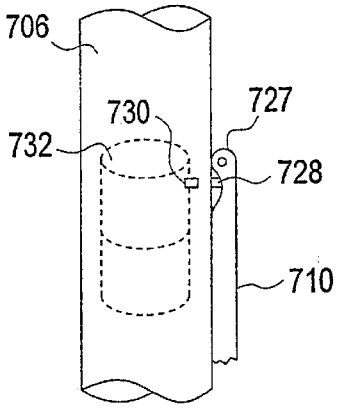

Referring now to FIG. 7, there is shown a present invention triggering system for an electric motor operated pump. The end of a line in connection with a trigger 710 pivots on a pin 727. When the line is pulled, the movement causes a contact 728 at the end of the line to be in contact with a second contact 730. This connection creates an electrical connection that may complete a circuit. The circuit is a conventional circuit know in the art. It includes a source of electric power and an electric motor 732. The source of electric power includes, but is not limited to batteries, electric power cord, and the like.

The motor 732 turn drives a pump when the circuit is completed. Letting up on the line will of course, break the contacts and stop the motor 732. Other conventional triggering means known in the art may also be used.

Figure 8:
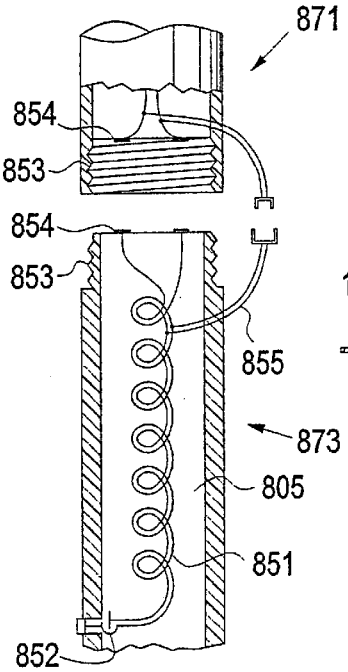
FIG. 8 shows an alternative embodiment triggering system thereof.

Referring now to FIG. 8, there is shown another triggering system for an electric motor operated pump. In this embodiment, there is a push button switch 852 located at the bottom of the extended handle or pole 805 and being in connection with electric coils 851 extending in an inner length of said device. The electric coils 851 carry a current when the circuit is completed by the push button switch 852, which drives an electric pump in connection with a reservoir.

An upper section 871 and a lower section 873 are connected my connecting means, in this case threads 853. Contacts 854 between the upper section 871 and the lower section 873 ensure that the circuit is completed. An optional line 855 having a plug at an end for connection to a similar line with a plug may be used to connect the switch 852 to an electric switch mounted in or near a spray trigger and so activate a manual pump by an electric switch.

Figure 9:
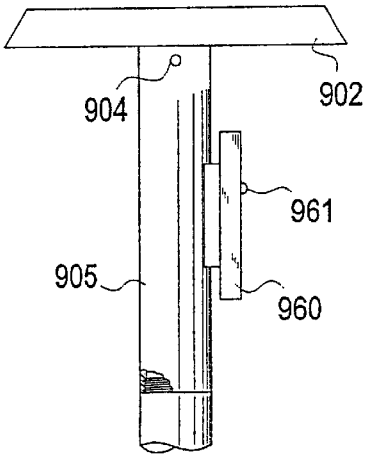
FIG. 9 shows an alternative embodiment of a pump trigger used in the present invention squeegee with squeegee handle and remote spraying device.

Referring now to FIG. 9, there is shown an alternative embodiment of a pump type trigger 960 used in conjunction with the present invention device. In this drawing, similar parts are identically numbered to those in FIG. 1, but beginning with "900".

The pump type trigger 960 is used when a squeegee handle is detached from the pole and only an extended handle or pole 805 is connected to a squeegee section 902. In operation, the pump trigger 960 is pulled downward to activate a pump that sprays a spraying agent. The pump trigger 960 may be spring loaded in order to return the pump trigger 960 to its rest position. An optional eyelet 961 may be used on the pump trigger 960 to accommodate a pull line that can be used when other sections are connected for full height. Such sections include, but are not limited to, telescoping attached sections, screw-in sections, clamped sections, hook and aperture sections, and the like.

Figure 10:
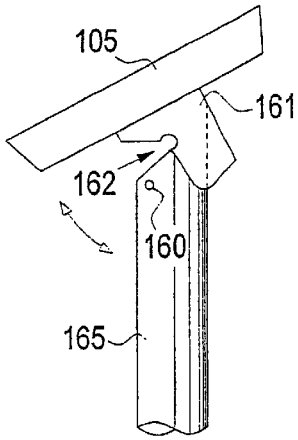
FIG. 10 shows a pivoting sprayer head of the present invention squeegee with squeegee handle and remote spraying device.

Referring now to FIG. 10, there is shown a present invention device having a head 105 of a squeegee section 161 that pivots on a top of the extended handle 165. As shown in the drawing, a lower section of the head 105 includes a cut-out section 162 that corresponds to a pin 160, which fits in to the cut-out section 162, Thus, the head 105 is locked into place when the device is ready to be used for spraying. When the device is not in use, the head 105 may be folded against a vertical support in order to minimize space for storage purposes. The pivoting movement is shown going in a counter-clockwise direction in FIG. 10, but it just as easily could go in a clockwise direction. It is within the scope of this invention that other conventional pivoting means may be used.

Figure 11:
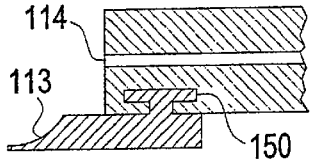
FIG. 11 shows an optional connection of a squeegee section to a front of a squeegee handle.

Referring now to FIG. 11, there is shown a sprayer head having a blade 113 in connection with the nozzle 114 where the blade 113 is below the nozzle 114. T-shaped channel 150 is in connection with the nozzle 114 and is sized and shaped for attachment of various wiping means such as a rubber blade, a rigid blade, a clamp, a sponge, a wiper, and the like.

Obviously, numerous modifications and variations of the present invention are possible in light of the above teachings. For example, the pump may be activated by any pump delivery system means. It is, therefore, understood that within the scope of the appended claims, the invention may be practiced otherwise than as specifically described herein.

What is claimed is:

1. A squeegee with squeegee handle and remote spraying device, which comprises:

(a) said squeegee handle being elongated and having connection to a squeegee section at a first end, and having threads at a second end for connection to an optional extended handle;

(b) a spraying system located within said squeegee handle, said spraying system including a nozzle exiting outwardly from said squeegee handle, said spraying system being connected to an enclosed reservoir, said spraying system having a dispensing means for dispensing liquid from said enclosed reservoir, said dispensing means including a conduit extending into said enclosed reservoir and a trigger in connection with said conduit, said conduit being connected to said nozzle, and said spraying system having a pressure inducing means connected functionally to said trigger for inducing an increase in pneumatic pressure in said conduit so as to draw liquid from said enclosed reservoir into said conduit and out of said nozzle;

(c) said enclosed reservoir being adapted to hold liquid, said enclosed reservoir being connected to said spraying system and said handle; and, (d) said squeegee section being located at and connected to said squeegee handle, said squeegee section having a squeegee blade, said squeegee blade being substantially perpendicular to said elongated squeegee handle, wherein said squeegee blade is located at a position selected from the group consisting of: (1) at said nozzle; (2) aligned below said nozzle; and (3) between said nozzle and said enclosed reservoir.

2. The squeegee with squeegee handle and remote spraying device of claim 1, which further comprises an extended handle being connected to said squeegee handle and extending downwardly therefrom.

3. The squeegee with squeegee handle and remote spraying device of claim 2 wherein said device further includes a line being in connection with said trigger whereby said trigger may be remotely activated.

4. The squeegee with squeegee handle and remote spraying device of claim 2 wherein said device further includes an electrical trigger activating means for remote activation of said trigger wherein said trigger activating means includes coiled extensions extending along an inner length of said device and having contacts between a top section of said device and a lower section of said device, and a remote activation switch on a lower section of said device wherein said contacts complete an electrical circuit for remote electrical switch operation.

5. The squeegee with squeegee handle and remote spraying device of claim 1, wherein a shape of said squeegee handle is selected from one of the group consisting of elongated circular, stocky circular, elongated polygonal, and stocky polygonal.

6. The squeegee with squeegee handle and remote spraying device of claim 5 wherein said handle is an extended handle that includes a plurality of sections wherein each of said sections includes extending means for extending each of said sections so that said extended handle may be extended in length wherein said extending means is selected from one of the group consisting of telescoping attached sections, and hook and aperture selections.

7. The squeegee with squeegee handle and remote spraying device of claim 1 wherein said spraying system further includes at least one attaching means for attaching a cleaning-related item for cleaning a recipient.

8. A squeegee with squeegee handle and remote spraying device, which comprises:

(a) said squeegee handle being elongated and having connection to a squeegee section at a first end, and having threads at a second end for connection to an optional extended handle;

(b) a spraying system located within said squeegee handle, said spraying system including a nozzle extending outwardly from said squeegee handle, said spraying system being connected to an enclosed reservoir, said spraying system having a dispensing means for dispensing liquid from said enclosed reservoir, said dispensing means including a conduit extending into said enclosed reservoir and a trigger in connection with said conduit, said conduit being connected to said nozzle, and said spraying system having a pressure decreasing means connected functionally to said trigger for decreasing pneumatic pressure in said conduit so as to draw liquid from said enclosed reservoir into said conduit and out of said nozzle;

(c) said enclosed reservoir being adapted to hold liquid, said enclosed reservoir being connected to said spraying system and said handle; and, (d) said squeegee section being located at and connected to said squeegee handle, said squeegee section having a squeegee blade, said squeegee blade being substantially perpendicular to said elongated squeegee handle, wherein said squeegee blade is located at a position selected from the group consisting of: (1) at said nozzle; (2) aligned below said nozzle; and (3) between said nozzle and said enclosed reservoir.

9. The squeegee with squeegee handle and remote spraying device of claim 8, which further comprises an extended handle being connected to said squeegee handle and extending downwardly therefrom.

10. The squeegee with squeegee handle and remote spraying device of claim 9 wherein said device further includes a line being in connection with said trigger whereby said trigger may be remotely activated.

11. The squeegee with squeegee handle and remote spraying device of claim 9 wherein said device further includes an electrical trigger activating means for remote activation of said trigger wherein said trigger activating means includes coiled extensions extending along an inner length of said device and having contacts between a top section of said device and a lower section of said device, and a remote activation switch on a lower section of said device wherein said contacts complete an electrical circuit for remote electrical switch operation.

12. The squeegee with squeegee handle and remote spraying device of claim 8 wherein a shape of said handle is selected from one of the group consisting of elongated circular, stocky circular, elongated polygonal, and stocky polygonal.

13. The squeegee with squeegee handle and remote spraying device of claim 12 wherein said handle is an extended handle that includes a plurality of sections wherein each of said sections includes extending means for extending each of said sections so that said extended handle may be extended in length wherein said extending means is selected from one of the group consisting of telescoping attached sections, and hook and aperture sections.

14. The squeegee with squeegee handle and remote spraying device of claim 8 wherein said spraying system further includes at least one attaching means for attaching a cleaning-related item for cleaning a recipient.

15. A squeegee with squeegee handle and remote spraying device, which comprises:

(a) said squeegee handle being elongated and having connection to a squeegee section at a first end, and having telescopic connection means at a second end for connection to at least one telescopically extending handle;

(b) a spraying system located within said squeegee handle, said spraying system including a nozzle extending outwardly from said squeegee handle, said spraying system being connected to an enclosed reservoir, said spraying system having a dispensing means for dispensing liquid from said enclosed reservoir, said dispensing means including a conduit extending into said enclosed reservoir and a trigger in connection with said conduit, said conduit being connected to said nozzle, and said spraying system having a pressure decreasing means connected functionally to said trigger for decreasing pneumatic pressure in said conduit so as to draw liquid from said enclosed reservoir into said conduit and out of said nozzle;

(c) said enclosed reservoir being adapted to hold liquid, said enclosed reservoir being connected to said spraying system and said handle; and, (d) said squeegee section being located at and connected to said squeegee handle, said squeegee section having a squeegee blade, said squeegee blade being substantially perpendicular to said elongated squeegee handle, wherein said squeegee blade is located at a position selected from the group consisting of: (1) at said nozzle; (2) aligned below said nozzle; and (3) between said nozzle and said enclosed reservoir.

16. The squeegee with squeegee handle and remote spraying device of claim 15, which further comprises at least one telescopically extending handle being connected to said squeegee handle and extending downwardly therefrom.

17. The squeegee with squeegee handle and remote spraying device of claim 16 wherein said extended handle includes a plurality of sections wherein each of said sections includes extending means for extending each of said sections so that said extended handle may be extended in length wherein said extending means is selected from one of the group consisting of telescoping attached sections, and hook and aperture sections.

18. The squeegee with squeegee handle and remote spraying device of claim 15 wherein a shape of said extended handle is selected from one of the group consisting of elongated circular, stocky circular, elongated polygonal, and stocky polygonal.

19. The squeegee with squeegee handle and remote spraying device of claim 15 wherein said device further includes a line being in connection with said trigger whereby said trigger may be remotely activated.

20. The squeegee with squeegee handle and remote spraying device of claim 15 wherein said device further includes an electrical trigger activating means for remote activation of said trigger wherein said trigger activating means includes coiled extensions extending along an inner length of said device and having contacts between a top section of said device and a lower section of said device, and a remote activation switch on a lower section of said device wherein said contacts complete an electrical circuit for remote electrical switch operation.

* * * * *